United States Patent [19]

Johnson

[11] Patent Number: 5,052,951

[45] Date of Patent: Oct. 1, 1991

[54] TERMINAL BLOCK

[75] Inventor: Richard B. Johnson, Tecumseh, Mich.

[73] Assignee: Draw-Tite, Inc., Canton, Mich.

[21] Appl. No.: 469,273

[22] Filed: Jan. 24, 1990

[51] Int. Cl.[5] ..... H01R 11/09

[52] U.S. Cl. ..... 439/723; 439/724

[58] Field of Search ..... 434/721, 722, 723, 724, 434/709, 283, 677, 650, 654

[56] References Cited

U.S. PATENT DOCUMENTS

| | | | |
|---|---|---|---|
| 2,703,395 | 9/1949 | Long | 439/723 |
| 3,263,202 | 7/1966 | Dean et al. | 439/724 |
| 3,998,517 | 12/1976 | Griffin | 439/723 |
| 4,108,525 | 8/1978 | Lincoln | 439/284 |

FOREIGN PATENT DOCUMENTS

| | | | |
|---|---|---|---|
| 0909719 | 4/1954 | Fed. Rep. of Germany | 439/677 |
| 0692853 | 11/1930 | France | 439/722 |

*Primary Examiner*—Larry I. Schwartz
*Assistant Examiner*—Hien D. Vu
*Attorney, Agent, or Firm*—Alex Rhodes

[57] ABSTRACT

A compact universal terminal block for connecting single wire conductors to plural wire conductors in series-parallel electrical circuits. The terminal block has a generally rectangular insulative housing with a stepped end portion and plural unitary connectors inside of the housing. Each connector is made from a blank of conductive material and has an input terminal and multiple tubular output terminals for operatively connecting multiple wire conductors to a single wire conductor. The tubular output terminals are arranged in parallel and staggered relationship with respect to each other to minimize the size of the terminal block and the amount of material used for stamping the connectors. Connectors having differing numbers of output terminals are provided in the common insulative housing to serve the requirements of many users.

12 Claims, 1 Drawing Sheet

TERMINAL BLOCK

BACKGROUND OF THE INVENTION

This invention relates generally to electrical terminal blocks and more particularly to a universal compact terminal block for connecting single wire conductors to a plurality of wire conductors in series-parallel electrical circuits.

Terminal blocks for connecting a single wire conductor to a plurality of wire conductors in series-parallel circuits are used for supplying electrical current from a single power source to multiple loads, by way of example, supplying current from a vehicle power supply to the stop lights, running lights and turn signal lights of a vehicle trailer. The terminal blocks have connectors which are generally encased in insulative housings. The connectors are generally made in stamping dies by blanking and forming thin sheets of conductive materials.

Electrical hook-ups commonly vary from installation to installation because of differences in amounts of equipment, types of equipment and the current requirements. Electrical equipment is generally connected in parallel with other equipment and in series with a common power source, such as a vehicle alternator. Separate parallel branches of conductors are generally required because of functional, safety and/or fuse differences. Electrical wiring is generally color coded to instruct users on how to make electrical connections.

One problem in the prior art is that plural terminal blocks and jumper wires are required to connect equipment because standard terminal blocks are not capable of connecting a single wire conductor to more than one pair of wire conductors. Multiple terminal blocks and jumper wires in electrical circuits reduce reliability and add to the time and cost of installing equipment. Another problem is that space is sometimes unavailable for the optimum routing of electrical wires with multiple conductors. Another problem is that excessive amounts of offal (i.e. scrap) is produced during stamping of connectors. This adds to the cost of the connectors.

Sitzler U.S. Pat. No. 3,128,143; Van Horssen U.S. Pat. No. 3,256,510; Dean et al U.S. Pat. No. 3,263,202; Radocy U.S. Pat. No. 3,273,108; and Ruehlemann U.S. Pat. No. 3,354,424 are exemplary of the prior art.

Van Horssen discloses a pin type terminal block having aligned input and output terminals in side by side co-planar relationship. Dean, Radocy and Ruehlemann disclose pin terminal blocks having co-planar terminals wherein the input terminals are arranged in line with the output terminals and the output terminals are arranged in side by side aligned relationship with each other. Sitzler discloses a terminal block having co-planar terminals wherein an input terminal is in side by said relationship with a first output terminal and in line with a second output terminal.

Sitzler, Van Horssen, Radocy and Ruehlemann are limited to connecting a single wire conductor to a single pair of wire conductors and excessive offal is produced from the stamping of the conductors. Sitzler is a multipiece connector.

SUMMARY OF THE INVENTION

The present invention overcomes the foregoing problems by providing plural compact connectors with variable numbers of output terminals in a common insulative housing. The invention resides in a flexible unitary connector design which is economical, compact and adaptable to a variety of connectors for operably connecting single wire conductors to multiple wire conductors. Identical connectors or conductors having different numbers of output terminals may be encased in a common housing to provide a universal terminal block which will serve the needs of different users.

One benefit of the invention is reduced cost, because offal is reduced during the stamping of the connectors. Another benefit is improved wire routings because of the unitary compact terminal block. Another benefit is improved reliability because of the reduced number of connections in electrical circuits and the elimination of jumper wires.

Each connector is made from a conductive material and has a single input terminal for attaching a wire conductor and at least one pair of output terminals. The output terminals of the connectors are arranged in staggered longitudinal relationship to each other to minimize cost by reducing the size of their blanks. The staggered relationship of the output terminals is the key feature for reducing offal and providing a compact terminal block.

Further benefits and features will be apparent from the ensuing description and accompanying drawings which disclose the invention in detail. The best mode contemplated in practicing the invention is disclosed and the subject matter in which exclusive rights are claimed is set forth in each of the numbered claims at the conclusion of the detailed description.

DETAILED DESCRIPTION OF THE PREFERRED EMBODIMENT

Figure 2:
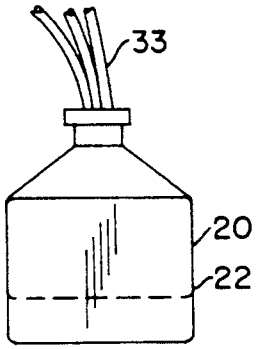
FIG. 2 is a plan view of the terminal block of FIG. 1.

Referring initially to FIGS. 1 through 5, inclusive, wherein like numerals designate like and corresponding parts throughout the several views, a terminal block 20, designated by the numeral 20, is illustrated therein for connecting a single wire conductor to a plurality of wire conductors in series-parallel circuits. The terminal block 20 is comprised of plural unitary connectors 21 in a common housing 22 made from an insulative material. The connectors 21 are stamped from sheets of conductive materials, such as copper or brass, in blanking and forming dies.

Figure 6:
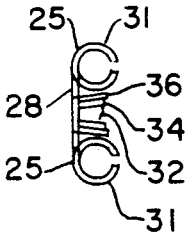
FIG. 6 is an end view of a connector.
Figure 7:
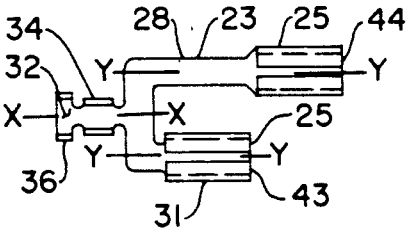
FIG. 7 is a front view of the connector shown in FIG. 6.
Figure 8:
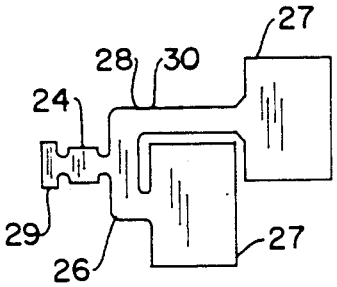
FIG. 8 shows the shape of the blank for the connector of FIG. 7.

In the embodiment 23 of FIGS. 6 through 8, inclusive, the unitary conductor 23 is a generally planar conductor having a solderless input terminal 24 for attaching a single wire conductor and a pair of female tubular output terminals 25 for attaching a pair of wire conductors. The insulated female tubular output terminals 25 are desirable to avoid accidental short circuits when the terminals 25 are not in use. Although the input terminal 24 is shown as a solderless terminal, any other type of conventional terminal may be used, such as the tab terminal shown in U.S. Pat. No. 4,158,745, incorporated herein by reference, or a tubular terminal, such as the output terminal 25. The input terminal 24 is near the center of the blank 26 and its axis X—X is in parallel relationship to the axes Y—Y of the tubular output terminals 25. The output terminals 25 are staggered in the longitudinal direction to reduce the size of the terminal block 20 and the amount of material for making the conductor 23. The material savings with the staggered output terminals 25 is apparent from reference to corresponding blank 26, shown in FIG. 8.

At one end of the blank 26 there is a pair of rectangular tabs 27 which form the tubular output terminals 25. The rectangular tabs 27 overlap and are connected by an intermediate portion 28 to a tab 29 from which the integral input terminal 24 is formed. The output terminal tabs 27 of the blank 26 are staggered both axially and laterally and are connected to the input terminal tab 29 by the narrow arms 30 of the intermediate portion 28. It will be observed that the staggered configuration of the output terminal tabs 27 is a distinguishing feature and the basis for reducing offal.

Figure 1:
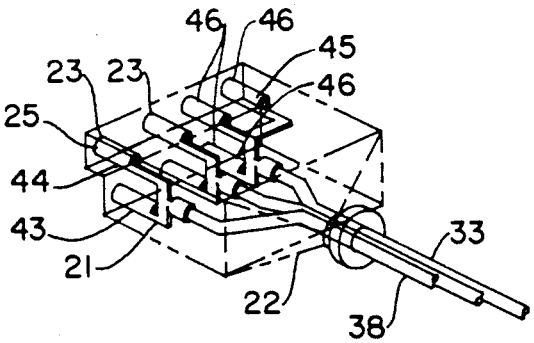
FIG. 1 is a perspective view of a terminal block housing in phantom with terminals in the interior of the housing.
Figure 3:
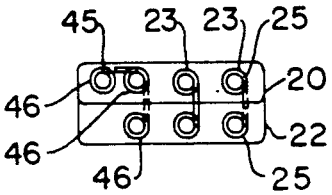
FIG. 3 is a front view of the terminal block shown in FIG. 1.
Figure 4:
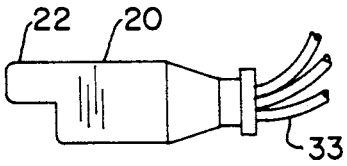
FIG. 4 is a left side view of the terminal block shown in FIG. 1.
Figure 5:
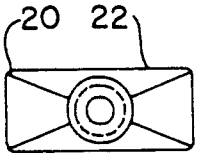
FIG. 5 is a left side view of the terminal block shown in FIG. 1.

The finished connector 23 is shown in FIGS. 6 and 7. The connector 23 is formed in a die by curling the output terminal tabs 27 into tubes 31 and forming the input terminal tab 29 into an upward opening "U" shaped trough 32. With reference to FIG. 1, a wire 33 is attached to each of the input terminals 24 by crimping the inner tabs 34 around the end of the conductor portion of the wire 33 and the outer tabs 36 around the insulated portion of the wire 33. The connector and wire assembly 38 is placed in a mold with other similar assemblies and an insulative housing 22 is molded around the conductors 21, leaving the interiors of the tubular output terminals 25 free of insulative material.

Figure 9:
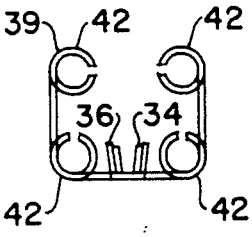
FIG. 9 is an end view of an alternate embodiment of the connector.
Figure 10:
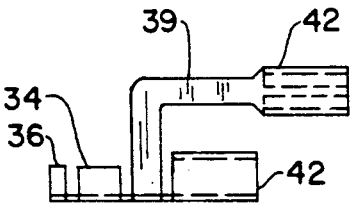
FIG. 10 is a front view of the connector shown in FIG. 9.
Figure 11:
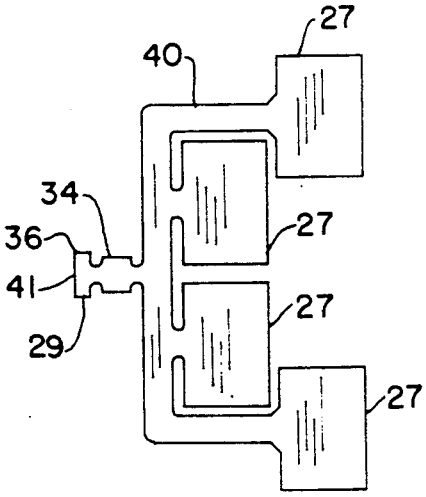
FIG. 11 shows the shape of the blank for the connector of FIG. 10.

Referring now to the alternate embodiment shown in FIGS. 8 through 11, inclusive, a single input terminal 29 is joined to four output terminals 44, allowing as many as four loads to be connected. The connector 39 is noncoplanar and is formed from a blank 40 having a single input terminal 41 and four tubular output terminals 42. The blank 40, as shown in FIG. 11, is equivalent to the combination of the blank shown in FIG. 11 and a symmetrically opposite portion.

With reference to FIGS. 9 and 10, the single input terminal 41 is joined to the two pairs of tubular output terminals 42, each of said pairs 42 having one tubular output terminal 43 in staggered axial relationship to a second output terminal 44.

In FIGS. 1 through 5, a pair of connectors 23, of the same type as FIGS. 6 and 7, each having two tubular output terminals 25 is shown combined with a third connector 45 having three output terminals 46, in a common housing 22 shown in phantom. Thus, it is clear that with my invention a variety of connectors with different numbers of output terminals can be economically made and combined in a common insulative housing.

From the foregoing, it is apparent that my invention provides a terminal block of a type heretofore unavailable for connecting single wire conductors to multiple wire conductors in series-parallel circuits. Moreover, my invention can serve as a universal terminal block for satisfying the requirements of multiple users.

Although but several embodiments have been described, it will be understood that other embodiments can be derived by changes in the size, shape and arrangement of parts without departing from the spirit thereof.

I claim:

1. A terminal block for electrically connecting a single wire conductor to a plurality of wire conductors in electrical circuits comprising: at least one unitary connector made from a single blank of conductive material, said blank having longitudinally staggered tab portions with narrow interconnecting portions for reducing offal and forming a compact connector with more than two output terminals, said unitary connector having an input terminal portion for attaching a wire conductor, more than one pair of tubular output terminal portions for attaching a pair of wire conductors to said first conductor and narrow portions for connecting said input terminal portion to said output terminal portions, said output tubular terminal portions being disposed inc lose staggered and parallel relationship to each other; and an insulative housing encasing said unitary connector.

2. A terminal block recited in claim 1 wherein said input terminal portion is a solderless terminal portion.

3. The terminal block recited in claim 1 wherein said input terminal portion is a flat tab type terminal portion.

4. The terminal block recited in claim 1 wherein said input terminal is a tubular terminal portion.

5. The terminal block recited in claim 1 further comprising said insulative housing having a recessed end portion aligned with the outer end portions of said pair of tubular output terminal portions.

6. The terminal block recited in claim 1 further comprising a third tubular output terminal portion of said unitary connector, said third tubular output terminal portion being disposed in spaced apart parallel relationship to one of said first pair of tubular output terminal portions.

7. The terminal block recited in claim 6 wherein the axes of said first described pair of tubular output terminal portions of said unitary connector lie in a first plane and the axis of said third tubular output terminal portion and one of said first pair of tubular output terminal portions lie in a second plane which is orthogonal to said first plane.

8. The terminal block recited in claim 1 further comprising a second pair of tubular output terminal portions of said unitary connector, each output terminal of said second pair being in spaced apart parallel relationship to one of said first described pair of tubular output terminal portions of said unitary connector.

9. The terminal block recited in claim 8 wherein the axis of at least one of said second pair of tubular output terminal portions of said connector and the axis of one of said first pair of tubular output terminal portions of said connector lie in a plane which is orthogonal to the plane of the axes of said first pair of tubular output terminal portions of said connector.

10. The terminal block recited in claim 6 wherein said input terminal portion of said connector is an upward opening "U" shaped portion having a first pair of tabs for attaching a conductor portion of an insulated wire conductor and a second pair of tabs for attaching an insulated portion of said conductor.

11. The terminal block recited in claim 10 wherein at least one of said unitary connectors has a third tubular output terminal portion, said third output terminal portion being in parallel relationship to said first pair of tubular output terminals and aligned with one of said first pair of tubular output terminals.

12. A terminal block for electrically connecting a single wire conductor to a plurality of wire conductors in electrical circuits comprising: at least one unitary connector made from a single blank of conductive material, comprising: a plurality of unitary connectors, each of said connectors made from a single blank of a conductive material, each of said blanks having staggered tab portions with narrow interconnecting arm portions for reducing offal and forming a compact connector with an input terminal and more than two output terminals, each of said connectors having more than one pair of tubular output terminal portions, said tubular output terminal portions being disposed in close parallel and staggered relationship to each other; and a generally rectangular insulative housing encasing said plurality of unitary connectors.

* * * * *